US007124537B2

(12) United States Patent
Young

(10) Patent No.: US 7,124,537 B2
(45) Date of Patent: Oct. 24, 2006

(54) DECORATIVE SHUTTER WITH HIDDEN LOUVER CONTROL

(76) Inventor: Stephen C. Young, 11840 Provincetowne Dr., Charlotte, NC (US) 28277-9165

( * ) Notice: Subject to any disclaimer, the term of this patent is extended or adjusted under 35 U.S.C. 154(b) by 354 days.

(21) Appl. No.: 10/817,997

(22) Filed: Apr. 5, 2004

(65) Prior Publication Data

US 2004/0226222 A1 Nov. 18, 2004

Related U.S. Application Data

(60) Provisional application No. 60/462,517, filed on Apr. 11, 2003.

(51) Int. Cl.
*E06B 7/08* (2006.01)

(52) U.S. Cl. ..... 49/74.1; 49/82.1; 49/90.1; 49/403

(58) Field of Classification Search ..... 49/74.1, 49/82.1, 90.1, 403
See application file for complete search history.

(56) References Cited

U.S. PATENT DOCUMENTS

| | | | | |
|---|---|---|---|---|
| 13,141 | A | 6/1855 | Stevens et al. | |
| 103,854 | A | 6/1870 | Donato | |
| 312,051 | A | 2/1885 | Willer | |
| 312,053 | A | 2/1885 | Willer | |
| 425,542 | A | 4/1890 | Hantsche, Jr. | |
| 595,854 | A | 12/1897 | Lansing | |
| 2,760,242 | A | 8/1956 | Armstrong | |
| 2,898,035 | A | 8/1959 | Wheeler | |
| 2,903,257 | A | 9/1959 | Perrone | |
| 3,201,832 | A | 8/1965 | Hordis et al. | |
| 3,702,040 | A | 11/1972 | Roy | |
| 3,746,042 | A | 7/1973 | Finkel | |
| 3,758,988 | A | 9/1973 | Tachikawa | |
| 3,991,518 | A | 11/1976 | Ishihara | |
| 4,505,070 | A | 3/1985 | Clipp et al. | |
| 4,610,197 | A | 9/1986 | Van Becelaere | |
| 4,655,003 | A | 4/1987 | Henley, Sr. | |
| 4,834,163 | A | 5/1989 | Dickstein | |
| 4,887,391 | A | 12/1989 | Briggs, Sr. | |
| 4,974,362 | A | 12/1990 | Briggs, Sr. | |
| 4,996,793 | A | 3/1991 | Mazur | |
| 5,029,413 | A | 7/1991 | Javanovic | |
| 5,052,150 | A | 10/1991 | Chen | |
| 5,216,837 | A | 6/1993 | Cleaver et al. | |
| 5,379,551 | A | 1/1995 | Swapp | |
| 5,537,780 | A | 7/1996 | Cleaver et al. | |
| 5,778,598 | A | 7/1998 | Ohanesian | |
| 5,842,919 | A | 12/1998 | Lyons et al. | |
| 6,128,857 | A | 10/2000 | Morgan et al. | |
| 6,145,251 | A | 11/2000 | Ricci | |
| 6,263,632 | B1 | 7/2001 | Cadorette | |
| 6,314,680 | B1 | 11/2001 | Buckwalter et al. | |
| 6,536,162 | B1 * | 3/2003 | LaMay | 49/403 |

FOREIGN PATENT DOCUMENTS

| | | | |
|---|---|---|---|
| EP | 0 399 130 | * 11/1990 | 49/82.1 |
| JP | 54-121542 | 9/1979 | |

* cited by examiner

*Primary Examiner*—Jerry Redman
(74) *Attorney, Agent, or Firm*—Alston & Bird LLP

(57) ABSTRACT

A shutter includes a frame with frame members that are spaced apart from one another, and a series of louvers are respectively rotatably mounted to the frame members. At least one of the frame members includes a casing defining a cavity. A controller, which preferably includes a rack and pinion system, is at least partially positioned in the cavity for synchronously pivoting the louvers. A housing of the controller is preferably an extrusion that reinforces the casing.

18 Claims, 5 Drawing Sheets

DECORATIVE SHUTTER WITH HIDDEN LOUVER CONTROL

CROSS-REFERENCE TO RELATED APPLICATIONS

This application claims the benefit of U.S. Provisional Application No. 60/462,517, filed Apr. 11, 2003.

BACKGROUND OF THE INVENTION

The present invention relates to shutters with louvers, and more particularly to decorative louvered shutters for window or door openings.

Decorative louvered shutters have conventionally been made from wood. The louvers are pivotally mounted in a surrounding frame and can be rotated from an open to a closed position. Typically, an external control rod is connected to each of the louvers with staples. By moving the control rod, the louvers are simultaneously moved from an opened to a closed position and vice-versa. One of the problems of wood shutters is that the wood tends to warp. This is particularly troublesome for shutters designed for covering large openings, such as doors, where several shutter panels are connected by hinges to cover the opening. As a result of warping, the shutter panels become misaligned, and present an aesthetically unpleasing appearance.

More recently, decorative shutters have been introduced that are made from wood substitutes, such as plastics or structural foams. These shutters address some of the problems presented by wood shutters, such as warping, but present different issues. Shutter components made from polymer materials are not always as strong and as rigid as wood, and require different tools, fasteners and processes for fabrication into an assembled shutter.

BRIEF SUMMARY OF THE INVENTION

The present invention provides a decorative louvered shutter that can be made from wood or a wood substitute material, such as a synthetic polymer, and that has a unique hidden actuator mechanism for the louvers.

The decorative louvered shutter of the present invention includes a frame in which a series of louvers is mounted. The frame includes opposing spaced-apart frame members, and preferably each of the frame members includes a casing formed with an internal longitudinally extending cavity. For each frame member, the cavity is relatively large in relation to the cross-sectional area of the casing to reduce the weight and material cost of the casing. Preferably, the cavity has a cross-sectional area which is at least 35% of the overall cross-sectional area of the casing, and more desirably the cavity has a cross-sectional area which is at least 45% of the overall cross-sectional area of the casing. A rigid extrusion is positioned snugly within the cavity. The extrusion is preferably metal and provides strength and rigidity to the frame member, and facilitates assembling the shutter components into a shutter.

In accordance with one aspect of the present invention, the metal extrusion of one of the frame members is a housing of a controller that functions as a hidden actuator mechanism for the louvers. The activator mechanism preferably employs a rack and pinion system for synchronously pivoting the louvers. More specifically, the housing is positioned in the cavity of the respective casing and substantially closes the opening to the cavity, so that the controller is substantially concealed within the casing. Spindles are rotatably mounted to the housing and respectively corotationally mounted to the louvers. Each spindle has a pinion gear positioned within the cavity, and one or more toothed racks are mounted to the housing and mesh with the pinion gears for causing synchronous pivoting of the spindles and louvers.

The casing is suitably of a generally U-shaped cross-section, and includes opposing parallel spaced apart sides connected by an end wall that extends along the outwardly facing edge of the casing, with the sides and end wall thus defining said longitudinally extending cavity with a longitudinally extending opening along the inwardly facing edge of the casing. The extrusion has an exterior wall that closes the opening to the cavity and thus defines the edge surface of the casing that faces the louvers, side walls extending rearwardly from the exterior wall along each edge thereof that engage the inner surface of the sides of the casing. The side walls of the extrusion include, successively, an outermost side wall portion that engages the inner surface of the sides of casing, an inset medial side wall portion, and a rearmost side wall portion that also engages the inner surface of the sides of casing, the outermost and rearmost side wall portions forming a friction fit with the sides of the casing to retain the extrusion in position within the cavity. The extrusion further includes a medial web portion that interconnects the two opposed rearmost side wall portions.

The spindles in the first frame member project through a series of holes formed in the exterior wall of the extrusions and through a corresponding series of holes formed in said medial web portion and arranged in coaxial alignment with the holes in said exterior wall. Fittings of the spindles respectively connect the spindles to the louvers. Each of the spindles is preferably constructed of multiple pieces that are mounted to one another as part of the overall process of assembling the controller. The controller is preferably a self-contained unit that can be completely assembled separately from other components of the shutter and can be modularly incorporated into the shutter.

BRIEF DESCRIPTION OF THE DRAWINGS

Figure 1:
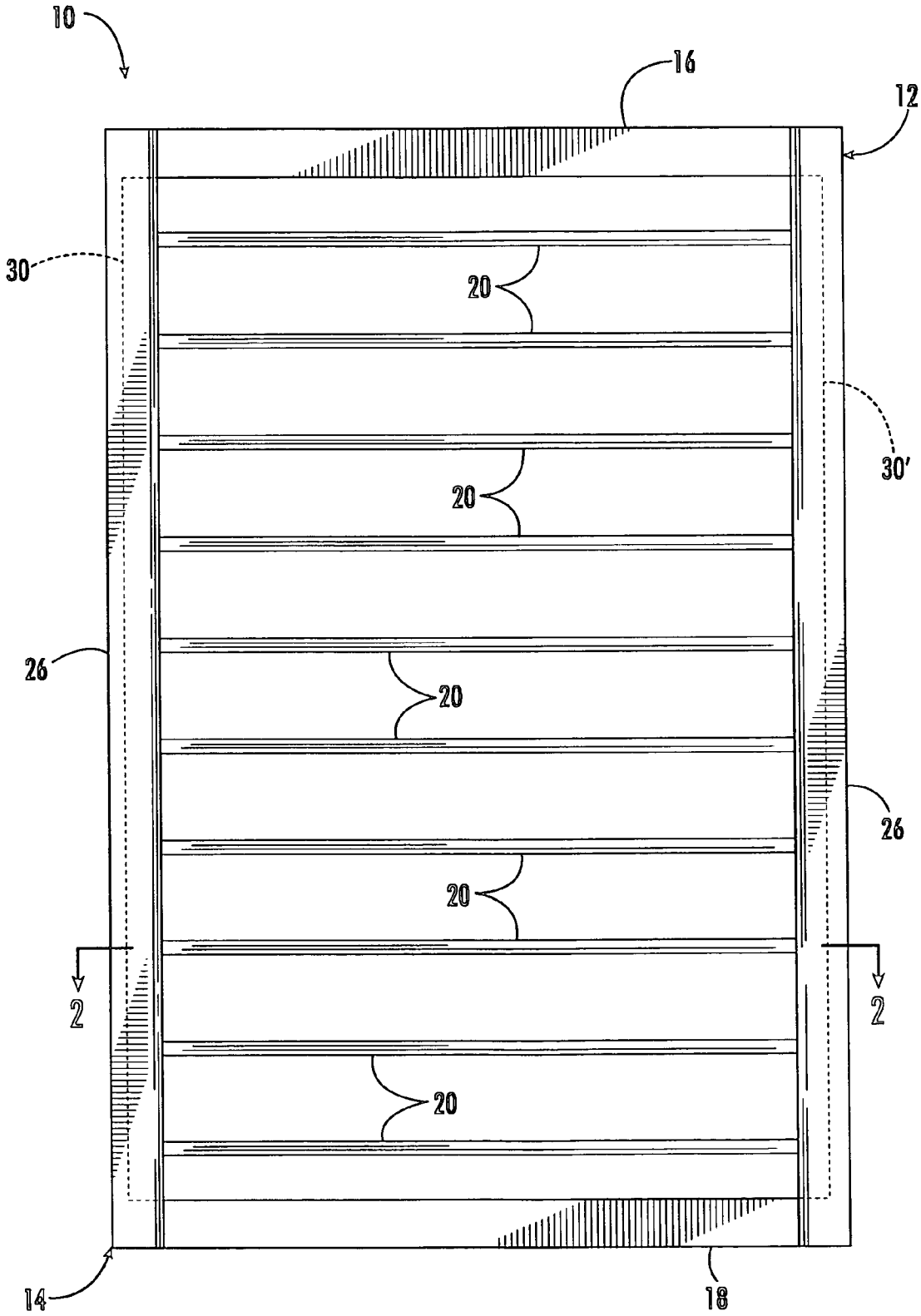
Figure 2:
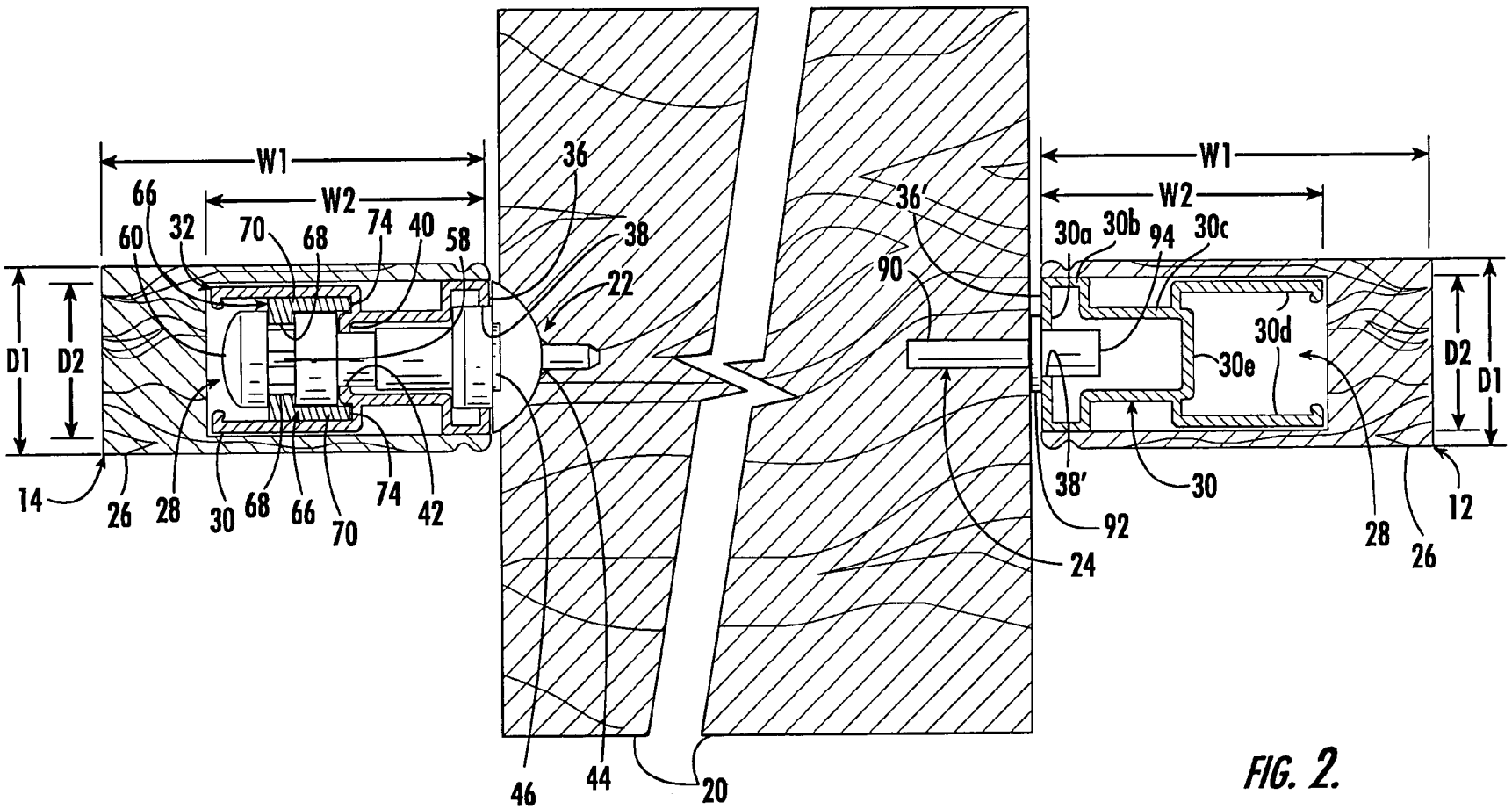
Figure 3:
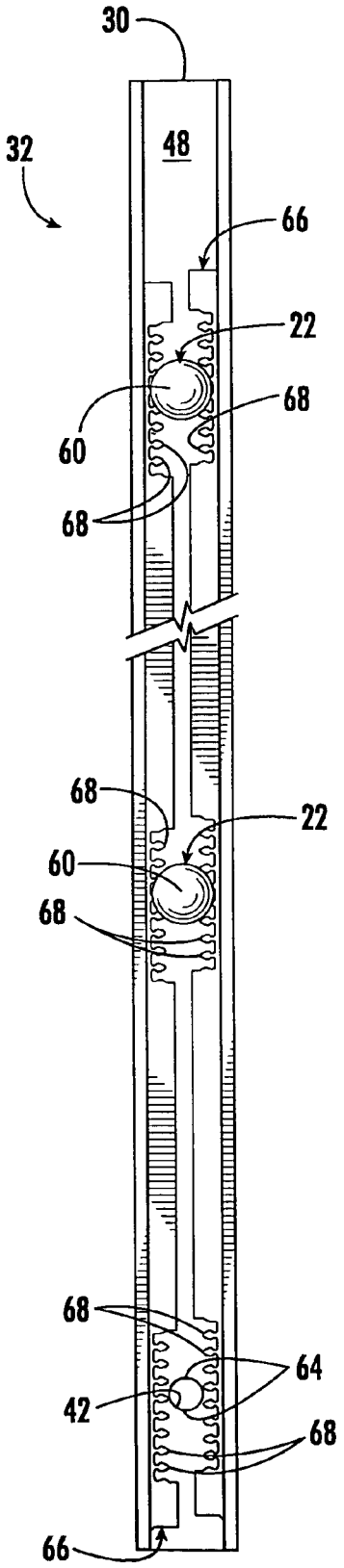
Figure 4:
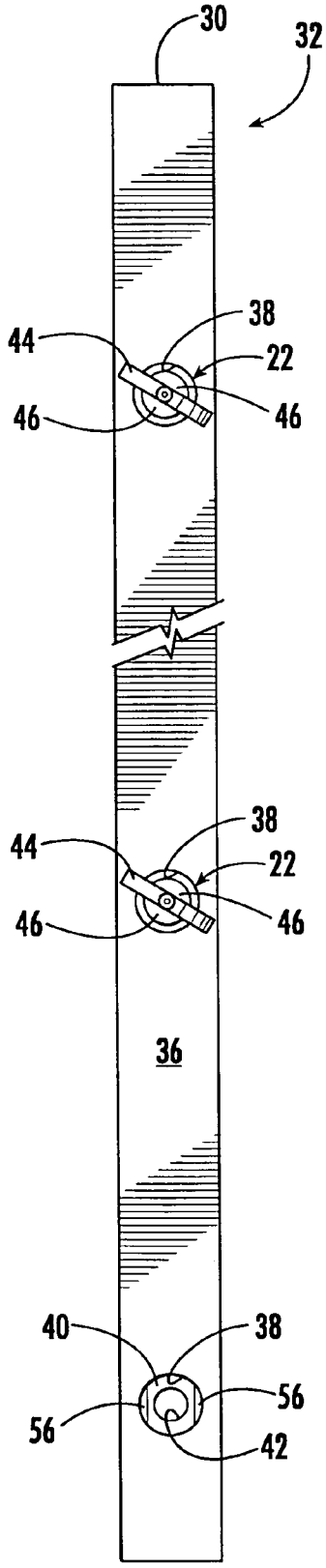
Figure 5:
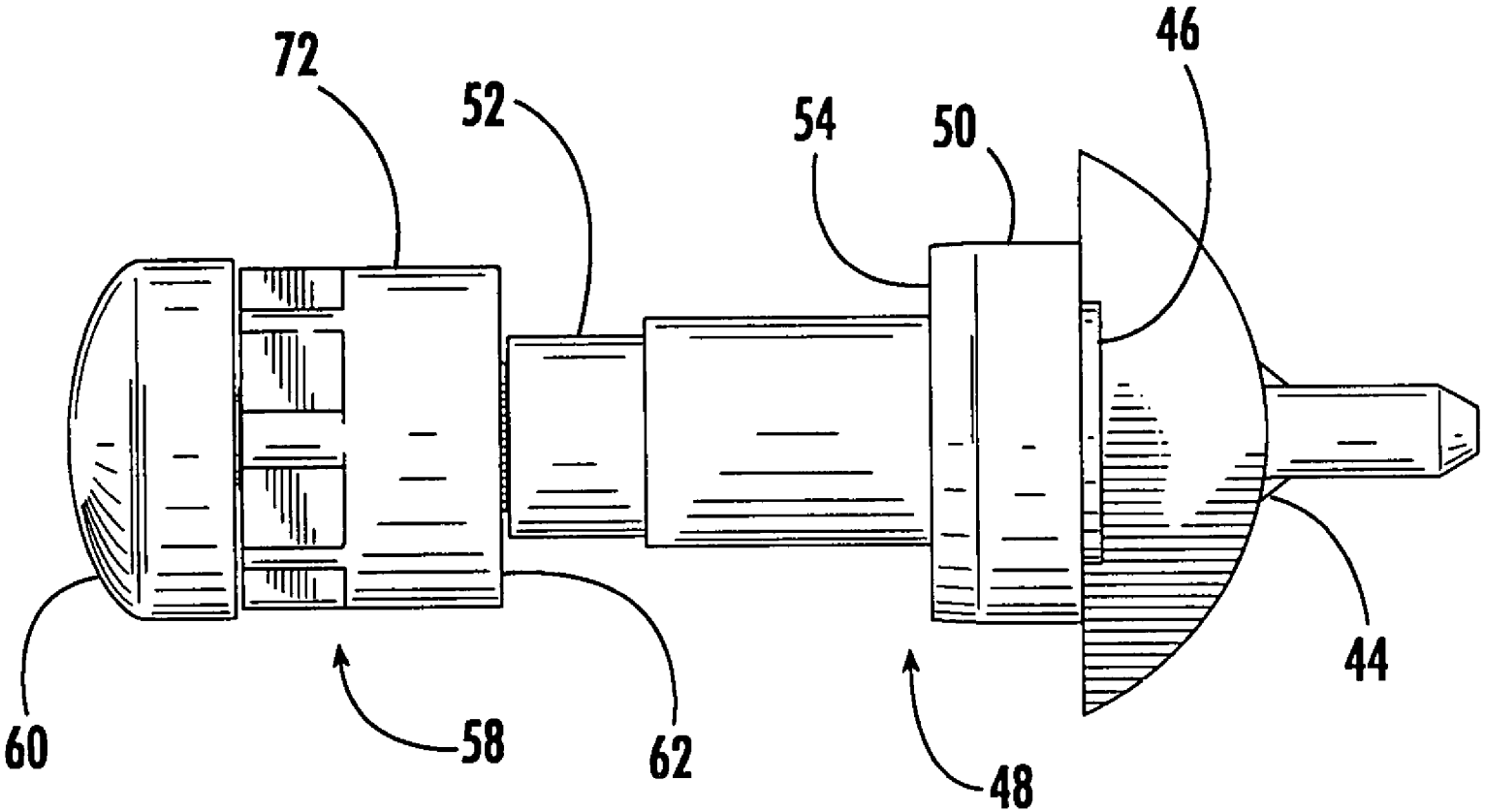
Figure 6:
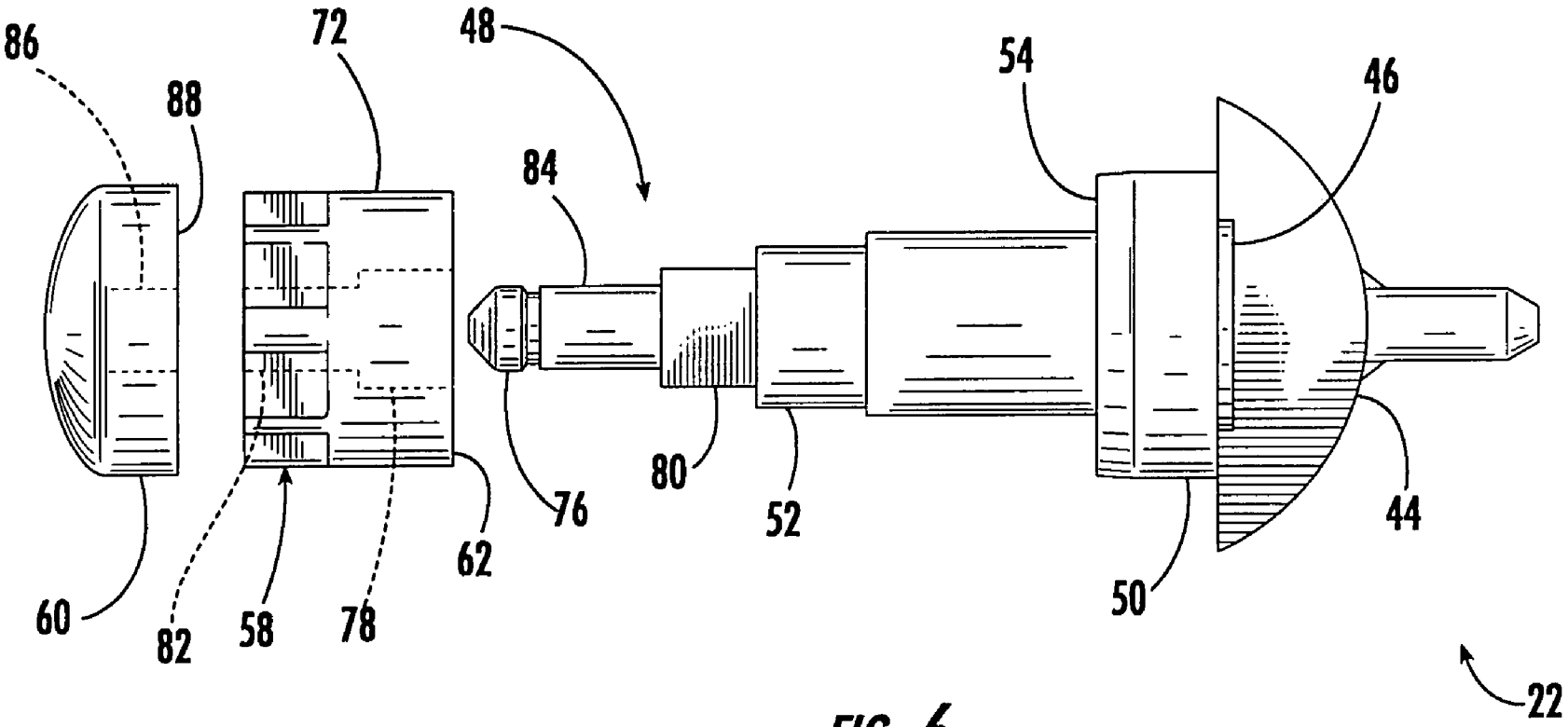

Having thus described the invention in general terms, reference will now be made to the accompanying drawings, which are not necessarily drawn to scale, and wherein:

FIG. 1 illustrates a decorative shutter with louvers that are in a fully open configuration, according to an exemplary embodiment of the present invention;

FIG. 2 is a horizontal, partially cross-sectional view taken along line 2—2 of FIG. 1, which is through the rotational axis of one of the louvers, with the associated spindles not being cross-sectioned and the lower being partially cut away for illustrative purposes;

FIG. 3 is an isolated, rear elevational view of a representative length of a controller that is part of the frame of the shutter of FIG. 1 and includes multiple active spindles, with one of the active spindles having been removed from the controller for illustrative purposes, and with the controller configured for having the louvers in a partially open configuration;

FIG. 4 is an isolated, front elevational view showing the opposite side of the controller of FIG. 3;

FIG. 5 is an isolated, side elevational view of an active spindle of FIGS. 2–3; and FIG. 6 is an isolated, side elevational, exploded view of the active spindle of FIG. 5.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Referring to FIG. 1, a decorative shutter 10 of an exemplary embodiment of the present invention includes a frame having longitudinally extending right and left frame members 12, 14 that are laterally spaced apart from one another, and laterally extending upper and lower frame members 16, 18 that are respectively mounted to the right and left frame members 12, 14. Multiple laterally extending louvers 20 are arranged in a series at longitudinally spaced apart locations along the length of the frame members 12, 14, with each louver having opposite ends that are rotatably mounted to the frame members 12, 14 for pivoting about respective laterally extending pivot axes. A hidden actuator mechanism, described more fully below, is provided within one of the frame members for mechanically interconnecting the respective louvers so that when a user pivotally adjusts one of the louvers, all of the remaining louvers will be similarly pivoted. In this way, a user can move the louvers as a unit from a fully closed position to an open position. Thus, the present invention avoids the need for an unsightly external actuator rod which is typically used on conventional wood louvered shutters for this purpose.

The right and left frame members 12, 14 each include a longitudinally extending casing 26 which is of a generally U-shaped cross-section, including opposing parallel spaced apart sides connected by an end wall that extends along the outwardly facing edge of the casing. The sides and end wall thus define a longitudinally extending cavity 28 (FIG. 2) within the casing 26 with a longitudinally extending opening along the inwardly facing edge of the casing. The louvers 20, casings 26, and upper and lower frame members 16, 18 are preferably manufactured from wood or a synthetic polymeric material, and most preferably from extruded foam polyvinyl chloride (PVC). To minimize weight and material costs, the casing is designed so that the cross-sectional area of the cavity 28 constitutes a relatively large portion of the overall cross-sectional area of the casing. As best seen from FIG. 2, the overall cross-sectional area of the casing can be calculated by multiplying the width (W1) of the casing 26 by its depth (D1). The cross-sectional area of the cavity can be determined by multiplying the width (W2) of the cavity by its depth (D2). Preferably, the cross-sectional area of cavity 28 is at least 35% of the cross-sectional area of the casing 26, and most preferably at least 45%.

As can also be seen from FIG. 2, an elongate rigid extrusion 30 is located within the cavity 28 of each casing 26. The extrusion, which is preferably made of a metal such as aluminum, has an exterior wall 30*a* that obstructs or closes the opening to the cavity 28 and thus defines the edge surface of the casing that faces the louvers. Extending rearwardly from the exterior wall 30*a* along each edge thereof are side walls that define, respectively, an outermost side wall portion 30*b* that engages the inner surface of the sides of casing 26, an inset medial side wall portion 30*c*, and a rearmost side wall portion 30*d* that also engages the inner surface of the sides of casing 26. The side wall portions 30*b* and 30*d* form a friction fit with the sides of the casing to retain the extrusion in position within the cavity 28. A medial web portion 30*e* interconnects the two opposed rearmost side wall portions 30*d*. The extrusions 30 serve to strengthen and rigidify the casings 26.

The louvers 20 are pivotally mounted to the frame members 12, 14 by spindles 22, 24. More specifically, the spindles 22 provided in frame member 14 are active spindles and are connected to an actuator mechanism 32 to be described in more detail presently, so that each active spindle 22 will rotate in unison. The spindles 24 provided in frame member 12 are passive spindles and are freely rotatable. The spindles 22, 24 project through a series of holes 38 formed in the exterior wall 30*a* of the extrusions 30. The holes 38 are uniformly spaced apart from one another by a distance slightly less that the overall width of the louvers 20 so that the louvers will slightly overlap one another when in the closed position. In the medial web portion 30*e* of the extrusion 30*a* that is present in the left frame member 14, a corresponding series of holes 42 is formed in coaxial alignment with the holes 38. Although not essential, such holes 42 may also optionally be provided in the other extrusion 30 present in the right frame member 12.

The active spindles 22 extend laterally and are rotatably mounted to the extrusion 30, occupying respective pairs of holes 38, 42. At its exposed outer end, the active spindle 22 is provided with a male fitting 44 which functions as a key. In the embodiment shown, the male fitting 44 is generally semicircular in shape, and is received in a correspondingly shaped keyway formed in the end of the adjacent louver 20. In this manner, any rotational movement of the active spindle 22 is transmitted to the louver and results in the louver pivoting on its axis. An annular spacer 46 is also present at the exposed outer end of the active spindle 22.

The passive spindle includes a male fitting 90 in the form of a pin that is received in a corresponding hole formed in the end of the adjacent louver 20. The passive spindle further includes an annular spacer 92 extending from the fitting 90 and a cylindrical journal 94 cooperating with the hole 38 in the outer wall 30*a*. Preferably, the passive spindles 24 are of an integral one-piece construction and formed from a suitable material such as metal or plastic.

Referring in greater detail to the active spindle 22, as best seen from FIGS. 5 and 6, it includes a shaft 48 extending rearwardly from the fitting 44 and having several zones or regions of differing diameter. Immediately adjacent the fitting 44 is a relatively large diameter region that forms a forward journal 50 to be received within the hole 38 in the outer wall 30*a* of extrusion 30. A shoulder 54 defines the transition to the next region, which is of smaller diameter than forward journal 50, and after a further reduction in diameter, a cylindrical rearward journal 52 is defined, which is intended to cooperate with the holes 42 formed in the medial web portion 30*e* of the extrusion. An adjacent region is of a non-circular cross-section, such as the square cross-section shown in the illustrated embodiment, and defines a key 80. After the key, the shaft 48 continues with a smaller diameter portion 84, terminating in a rounded head 76 that is separated from the smaller diameter portion by a groove.

As can be best seen in FIG. 6, the active spindle 22 also includes separate pieces that cooperate to form a pinion gear at the end of the spindle opposite the fitting 40. These pieces can be formed of injection molded plastic, and include a pinion gear 58 and a snap-on retainer cap 60. In the embodiment shown, the teeth of the pinion gear 58 are formed in a cylindrical body 72 having an axial opening that includes a non-circular cross-section keyway 78 corresponding in shape to the key 80 and a cylindrical opening 82 for receiving the smaller diameter portion 84 of the shaft 48. The cap 60 has a central opening 86 configured to provide a snap-fit with the rounded head 76 of the shaft so that the axially facing surface or shoulder 88 engages the pinion gear and holds these parts in assembled relationship.

The actuator mechanism 32 which is provided in the left frame member 14 also includes a rack and pinion system for synchronously controlling the opening and closing of the louvers 20. Referring to FIG. 2, a pair of racks 66 extend longitudinally within the extrusion 30 on opposite sides of the active spindle 22. The racks have teeth 68 that are respectively meshed with teeth of the pinion gears 58 for causing the active spindles 20 to rotate simultaneously. The racks 66 are held in place between the spindle 22 and the walls 30*d* of the extrusion and are prevented from shifting in a direction parallel to the axis of the spindle 22 by caps 60. As is apparent from FIG. 2, for each rack 66, the teeth 68 extend perpendicularly away from the base 70 of the rack so that the rack has a generally L-shaped cross-section. As can be seen in FIG. 3, the teeth 68 on the rack need not be continuous, but can be provided only in portions of the rack adjacent an active spindle. The ends of the untoothed regions can engage the pinion gears 58 and thereby function as stops for limiting the rotation of the louvers 20. Accordingly, the stops can be positioned to control the degree to which the louvers pivot 20, so as to prevent respective louvers from too tightly engaging one another or the upper and lower frame members 16, 18. In the illustrated embodiment, the racks are made of metal.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A decorative louvered shutter, comprising:

a frame including longitudinally extending first and second frame members that are laterally spaced apart from one another;

each frame member comprising a longitudinally extending casing formed with an internal longitudinally extending cavity and with an opening to the cavity extending longitudinally along one edge of the casing, and a longitudinally extending rigid extrusion positioned within the cavity, the extrusion having a hollow interior and including an exterior wall that substantially closes the opening to the cavity, with the wall having a plurality of holes arranged in a longitudinally extending series;

a plurality of laterally extending louvers arranged in a series along the longitudinal extent of said frame members, with each louver having opposite ends mounted respectively to the first and second frame members;

a spindle mounted at each end of each said louver and including a shaft portion projecting into a respective one of said holes in said exterior wall for thereby mounting the louvers to said first and second frame members for movement about respective lateral pivot axes;

a concealed actuator mechanism mounted in said first frame member and operable for causing each of the louvers to move simultaneously when one of the louvers is pivotally adjusted, said mechanism comprising a pinion gear provided on the shaft of the spindles in said first frame member, said pinion gear being positioned within the hollow interior of said extrusion;

a toothed rack having teeth, said rack being located within the hollow interior of said extrusion and meshing with the respective pinion gears of said spindles, and being movable longitudinally within the hollow interior of said extrusion for causing the simultaneous pivoting of the louvers when one of the louvers is pivotally adjusted.

2. A shutter according to claim 1, wherein the cavity in said casing has a cross-sectional area which is at least 35% of the overall cross-sectional area of the casing.

3. A shutter according to claim 2, wherein the cavity has a cross-sectional area which is at least 45% of the overall cross-sectional area of the casing.

4. A shutter according to claim 1, wherein the casing is of a generally U-shaped cross-section, including opposing parallel spaced apart sides connected by an end wall that extends along the outwardly facing edge of the casing, with the sides and end wall thus defining said longitudinally extending cavity with a longitudinally extending opening along the inwardly facing edge of the casing.

5. A shutter according to claim 4, wherein said extrusion is made of metal and has an exterior wall that closes the opening to the cavity and thus defines the edge surface of the casing that faces the louvers, side walls extending rearwardly from the exterior wall along each edge thereof that engage the inner surface of the sides of said casing.

6. A shutter according to claim 5, wherein the side walls of said extrusion include, successively, an outermost side wall portion that engages the inner surface of the sides of the casing, an inset medial side wall portion, and a rearmost side wall portion that also engages the inner surface of the sides of the casing, the outermost and rearmost side wall portions forming a friction fit with the sides of the casing to retain the extrusion in position within the cavity.

7. A shutter according to claim 6, wherein said extrusion further includes a medial web portion that interconnects the two opposed rearmost side wall portions.

8. A shutter according to claim 7 wherein the spindles in said first frame member project through a series of holes formed in the exterior wall of the extrusions and through a corresponding series of holes formed in said medial web portion and arranged in coaxial alignment with the holes in said exterior wall.

9. A shutter according to claim 1, wherein the spindles in said first frame member are active spindles and the spindles in said second frame member are freely rotatable passive spindles.

10. A shutter according to claim 1, wherein the toothed rack has a generally L-shaped cross-section, and the teeth are formed on one of the legs of the L-shaped cross section.

11. A shutter according to claim 1, including a keyway formed in each louver at the end thereof facing said first frame member, and a corresponding key provided on the end of each spindle in said first frame member and extending into the keyway in the louver.

12. A shutter according to claim 1, wherein the shaft portion of said spindle includes noncircular key portion, and wherein said pinion gear is a separate piece positioned on said shaft portion of said spindle and engages said noncircular key portion so that the pinion gear will rotate with said spindle.

13. A shutter according to claim 12, wherein the shaft portion of said spindle has a snap fitting formed at an end of the shaft portion, and including a snap-fit cap positioned on the snap fitting and serving to retain the spindle in assembled relationship.

14. A controller for controlling the opening and closing of louvers of a shutter, the controller comprising:

a longitudinally extending extrusion having an exterior wall, side walls extending rearwardly from the exterior wall along each edge thereof, said side walls including, successively, an outermost side wall portion, a rearmost side wall portion, and inset medial side wall portion between said outermost and rearmost side wall portions, a medial web portion that interconnects the two opposed rearmost side wall portions, a longitudinally spaced series of spindles projecting through a series of holes formed in the exterior wall of the extrusions and through a corresponding series of holes formed in said medial web portion and arranged in coaxial alignment with the holes in said exterior wall, a pinion gear associated with each spindle, and a longitudinally extending toothed rack having teeth meshed with the pinion gears.

15. A controller according to claim 14, including a first toothed rack that is positioned between one of the sidewalls and the pinion gears and a second toothed rack positioned between the pinion gear and a second one of the sidewalls.

16. A controller according to claim 15, wherein each toothed rack has a generally L-shaped cross-section, and the teeth are formed on one of the legs of the L-shaped cross section.

17. A controller according to claim 14, wherein each spindle has a shaft portion that includes a noncircular key portion, and wherein said pinion gear is a separate piece positioned on said shaft portion of said spindle and engages said noncircular key portion so that the pinion gear will rotate with said spindle.

18. A controller according to claim 14, including a key formed at an end of each spindle and adapted to extend into a corresponding keyway formed in a louver.

* * * * *